US011796215B2

(12) United States Patent
Laging et al.

(10) Patent No.: US 11,796,215 B2
(45) Date of Patent: Oct. 24, 2023

(54) DEVICE FOR DISTRIBUTING AIR

(71) Applicant: TRUMA GERÄTETECHNIK GMBH & CO. KG, Putzbrunn (DE)

(72) Inventors: Johannes Laging, Putzbrunn (DE); Kamil Ünnü, Putzbrunn (DE); Fikret Erdogan, Putzbrunn (DE); Siegfried Piegsa, Putzbrunn (DE)

(73) Assignee: TRUMA GERÄTETECHNIK GMBH & CO. KG, Putzbrunn (DE)

( * ) Notice: Subject to any disclaimer, the term of this patent is extended or adjusted under 35 U.S.C. 154(b) by 467 days.

(21) Appl. No.: 17/051,785

(22) PCT Filed: Apr. 26, 2019

(86) PCT No.: PCT/EP2019/060757
§ 371 (c)(1),
(2) Date: Oct. 30, 2020

(87) PCT Pub. No.: WO2019/211192
PCT Pub. Date: Nov. 7, 2019

(65) Prior Publication Data

US 2021/0123629 A1 Apr. 29, 2021

(30) Foreign Application Priority Data

May 2, 2018 (DE) ..... 10 2018 003 524.8

(51) Int. Cl.
*F24F 13/02* (2006.01)
*F24F 13/062* (2006.01)

(52) U.S. Cl.
CPC ..... *F24F 13/0236* (2013.01); *F24F 13/062* (2013.01)

(58) Field of Classification Search
CPC ..... F24F 13/0236; F24F 13/062
USPC ..... 454/258
See application file for complete search history.

(56) References Cited

U.S. PATENT DOCUMENTS

| | | | | |
|---|---|---|---|---|
| 2,380,553 A | | 7/1945 | Serre et al. | |
| 2,772,624 A | * | 12/1956 | Carnes | F24F 13/062 454/312 |
| 2,837,990 A | | 6/1958 | Tutt | |
| 3,087,407 A | | 4/1963 | Averill et al. | |
| 4,750,411 A | * | 6/1988 | Eversole | F24F 13/0236 285/192 |
| 4,876,952 A | | 10/1989 | Kuno et al. | |
| 9,322,561 B2 | | 4/2016 | Ikeda et al. | |
| 2013/0213614 A1 | | 8/2013 | Ikeda et al. | |

FOREIGN PATENT DOCUMENTS

| | | |
|---|---|---|
| CN | 104379999 A | 2/2015 |
| GB | 754 734 | 8/1956 |

* cited by examiner

*Primary Examiner* — Allen R. B. Schult
(74) *Attorney, Agent, or Firm* — McNees Wallace & Nurick LLC

(57) ABSTRACT

The invention relates to a device (1) for distributing air. The device (1) has a housing (2) which includes an air inlet opening (20) and a plurality of air outlet openings (21). Arranged in the housing (2) is a displacement element (3) which has at least one cutting plane that is configured as a cutting plane of a hollow cylinder widening along a longitudinal axis (26) of the housing (2).

6 Claims, 4 Drawing Sheets

DEVICE FOR DISTRIBUTING AIR

The present invention relates to a device for distributing air. An alternative designation is, for example, air diffuser.

Air diffusers are used to supply, discharge or generally to distribute air, for example in ventilation systems or in systems for the temperature control of rooms. The air may have been heated by a heating or air conditioning system, for example, or it may have been adjusted, for example, with respect to its humidity content. Such air diffusers are disclosed, for example, in DE 10 2008 006 021 A1 or FR 2 965 334 A1.

An air diffuser is also taught by EP 0 639 744 A2. A plurality of air outflow openings are located in a conically tapered chamber here. A plurality of saucer-shaped elements are arranged along a longitudinal axis of the chamber, which have permeable accumulation surfaces and widen in the direction of flow. The chamber tapers conically, with the saucer-shaped elements each having the same configuration. The distance between the wall of the chamber and the saucer-shaped elements thus generally decreases along the direction of flow.

A problematic aspect in air diffusers in general resides in that different quantities of air exit from the air outlet openings in the different directions. For example, a larger quantity of air exits from the air outlet opening opposite the air inlet opening than from an air outlet opening that is arranged laterally with respect to the air inlet opening. However, such differences make the planning or design of an air distribution system more complex.

The object underlying the invention is to propose a device for distributing air which allows substantially the same amount of air to exit from each of the different air outlet openings as related to different sides of the diffuser.

The invention achieves the object by a device for distributing air, which includes at least one housing. The housing has an air inlet opening and a plurality of air outlet openings. At least one displacement element is arranged in an interior of the housing. The at least one displacement element has at least one (special or distinguished) cutting plane. The cutting plane of the displacement element is configured as a cutting plane of a hollow cylinder widening along a longitudinal axis of the housing.

In one configuration the widening is more particularly conical. In one configuration the widening relates only to a part or section of the hollow cylinder.

The device according to the invention for distributing air includes a housing having at least one air inlet opening and a plurality of, that is, at least two, air outlet openings. In order to achieve the discharge of substantially identical air flows from the air outlet openings, at least one displacement element is located in the housing. The displacement element is constructed such that it has at least one cutting plane that corresponds to the cutting plane as featured by a hollow cylinder widening along the longitudinal axis.

In one design, the displacement element is in the form of a hollow cylinder. In an alternative design, the displacement element is not rotationally symmetrical, but the displacement element has the aforementioned cutting plane, with the sections of the hollow cylinder being extended by lateral walls to form spatial structures. In one configuration, the hollow cylinder has a circular cross-section.

The at least one displacement element causes the air to be distributed within the interior of the housing, so that substantially the same amount of air exits from the outlet openings on the different sides of the housing. Therefore, if, for example, the air exit from three sides is compared, the displacement element leads to approximately one third, respectively, of the amount of air that is introduced via the air inlet opening. Since the shape of the displacement element is similar to that of a hollow cylinder, the air also flows in particular through the displacement element.

In one configuration, the at least one displacement element is spaced apart from an inner wall of the housing such that air flows around the at least one displacement element. In this configuration, there is thus sufficient free space between the displacement element, or more specifically, its outer surface, and the inner wall of the housing so that the air can flow around the displacement element. In one configuration, provision is made for a plurality of displacement elements and for them to be designed and arranged in such a way that the air flows around them. The air is thus not only guided through the displacement element or, where desired, through several displacement elements, but the air also flows around it/them.

In one configuration, it is preferably provided that the displacement element has its smallest outside diameter toward the air inlet opening.

For the comparison of the exiting air quantities, in particular air outlet openings are considered which are located on different sides of the housing. For the comparison of the air quantities, similar diameters of the openings will also be considered or, in the case that several openings are positioned on one side, the sum of the individual air quantities for the side in question will be formed.

According to one configuration, the at least one displacement element is of a rotationally symmetrical design. In one configuration, the symmetry of rotation is given about a longitudinal axis of the housing, the longitudinal axis preferably extending through the air inlet opening.

In a further configuration, one of the two aforementioned configurations includes the feature that the displacement element substantially has the shape of a hollow cylinder conically widening along a longitudinal axis of the housing. This means that the cutting plane is rotationally symmetrically extended to form a hollow cylinder.

According to one configuration, the at least one displacement element includes at least two sections. A first section has a substantially constant diameter and a second section has a diameter that increases along the longitudinal axis. Depending on the configuration, the diameter refers to the inside diameter and/or the outside diameter of the hollow cylinder. The first section and the second section follow each other directly or indirectly, depending on the configuration.

In one configuration, at least two displacement elements are provided in the interior of the housing. In one configuration, the displacement elements are designed to be identical with regard to their basic geometric shape so that the at least two displacement elements each have a cutting plane in the nature of a cutting plane of a conically widening hollow cylinder.

One configuration provides that the at least two displacement elements are conically widening hollow cylinders.

In one configuration, the at least two displacement elements are arranged along the longitudinal axis such that they partly overlap. This means that in this design, the at least two displacement elements are partly fitted into each other along the longitudinal axis.

In one configuration, it is provided that the two displacement elements that are axially partly fitted into each other do not touch each other. In an alternative configuration, the at least two displacement elements are arranged axially along the longitudinal axis without overlapping, so that the at least two displacement elements follow each other axially.

In one configuration, at least one displacement element is statically fixed in position. In this configuration, the displacement element is thus more particularly immovably mounted in the housing.

As a supplement, in a further configuration a plurality of displacement elements are provided, which are all statically fixed in the housing. Due to the static fixation, a modification of the displacement elements with regard to shape, orientation or positioning in the housing is therefore not possible. In particular, no control for a mechanical actuation or rearrangement of the displacement element or elements is provided.

In one configuration, the at least two displacement elements are essentially of identical design. In an alternative configuration, the two displacement elements differ from each other, e.g. with respect to their axial extent, with respect to the degree of conical expansion or with respect to the different radii of the cylinder cross-sections. In one configuration, the displacement elements have the same basic shape or geometry, so that they are at least similar in appearance.

In one configuration, the at least two displacement elements are constructed and arranged in the interior of the housing such that the displacement elements are symmetrical, preferably rotationally symmetrical, about the longitudinal axis.

In one configuration, the longitudinal axis of the housing extends from a center of the air inlet opening to a center of an air outlet opening opposite the air inlet opening.

In one configuration, the device and in particular the housing are constructed to be symmetrical about the longitudinal axis. In one configuration, the housing is formed by two symmetrical housing shells.

According to one configuration, the at least two displacement elements have different end radii. The end radii here are the radii of the respective face sides of the displacement elements with the largest cross-sectional area of the displacement element concerned.

In one configuration, the end radii decrease along the longitudinal axis of the housing starting from the air inlet opening, so that starting from the air inlet opening the end radii of the displacement elements become smaller. Specifically, this means that a displacement element located closer to the air inlet opening has a larger end radius than a displacement element that follows and is located further away from the air inlet opening.

Alternatively or additionally, according to a further configuration, the at least two displacement elements have different inlet radii. Corresponding to the aforementioned configuration, the inlet radii here are the radii of the respective face sides of the displacement elements with the smallest cross-sectional area of the displacement element concerned. These are therefore also the face sides facing the air inlet opening. The different inlet radii also serve to arrange the individual displacement elements partly inside each other.

In one configuration, provision is made that the at least two displacement elements have different axial extents. In this configuration, the displacement elements therefore have different lengths in the axial direction.

An alternative or supplementary configuration resides in that the at least two displacement elements start from a shared plane perpendicular to the longitudinal axis. In this configuration, the displacement elements each commence at the same level along the longitudinal axis of the housing.

This configuration is accompanied in one configuration by the feature that the displacement elements have different inlet radii. This allows the air to be able to flow also between the outside of a first displacement element and the inside of a second, surrounding, displacement element. In an additional configuration, it is also provided that the displacement elements have different axial extents and/or different end radii.

In one configuration, provision is made that the air inlet opening is opposite one of the plurality of air outlet openings in the housing. In this configuration, a direct connection thus exists between the air inlet opening and an air outlet opening in question. At least one further air outlet opening is located laterally of the connection between the air inlet opening and the particular aforementioned air outlet opening.

In one configuration, at least one air outlet opening allows the connection to a pipe for further guiding the air. The air outlet opening thus has, for example, a connecting piece or a recess that allows a pipe to be connected.

In one configuration, the air inlet opening is adapted to be connected to an air-expelling unit, in particular fluidically with respect to the air. In one configuration the air-expelling unit is a heating unit, and in a different configuration it is an air conditioning system. In this configuration, the device has at least one connecting or junction point for a connection to a corresponding counterpart of the air-expelling unit.

In one configuration, it is provided that the device is part of an air-expelling unit. In contrast to the preceding configuration, here the device is part of, e.g., a heating or an air conditioning system, as examples of the air-expelling unit.

One configuration consists in that the housing has essentially the shape of a cube. In a supplementary configuration, the air inlet opening and the air outlet openings are located on the respective planar sides of the cube-shaped housing. In an alternative configuration, the housing has rounded or elliptical or at least edge-free contours. In one configuration, more than one air outlet opening is located on at least one side of the cube.

According to one configuration, the housing consists of two housing halves. In one configuration, the housing halves are designed to be identical. The housing halves allow the manufacture and in particular the assembly of the device to be simplified.

In detail, there is a multitude of options to configure and further develop the device according to the invention. In this regard, reference is made, on the one hand, to the claims dependent on claim 1 and, on the other hand, to the description below of exemplary embodiments in conjunction with the drawings, in which:

FIG. 1 shows a configuration of the device 1 for distributing air, which is connected to an air-expelling unit 5, which in the exemplary embodiment shown is a heater.

The connection is effected here via associated interfaces for the transmission of air, so that in particular an air outlet—not visible here—of the unit 5 is in contact with the air inlet opening—also not visible here—of the device 1.

In an alternative configuration (not illustrated), a pipe is located between the unit 5 and the device 1. In one design, a pluggable connection is preferably provided between the device 1 and the unit 5 or a pipe.

In the variant shown, the housing 2 of the device 1 is designed to be substantially cube-shaped with planar side faces of substantially the same size. Located on the side faces are the openings, of which only the air outlet openings 21 are visible here. A total of six openings are provided; these are one air inlet opening and five air outlet openings 21.

Owing to the characteristics of the device 1, which are to be discussed in the following, approximately the same amount of air exits on each side of the housing 2, that is, approximately one fifth of the amount of air entering through the air inlet opening. The air outlet openings 21 here each have respective pipes connected thereto, which serve to further guide the air. Alternatively, the air outlet openings 21 can also be closed, or the air flows out of them directly.

Figure 1:
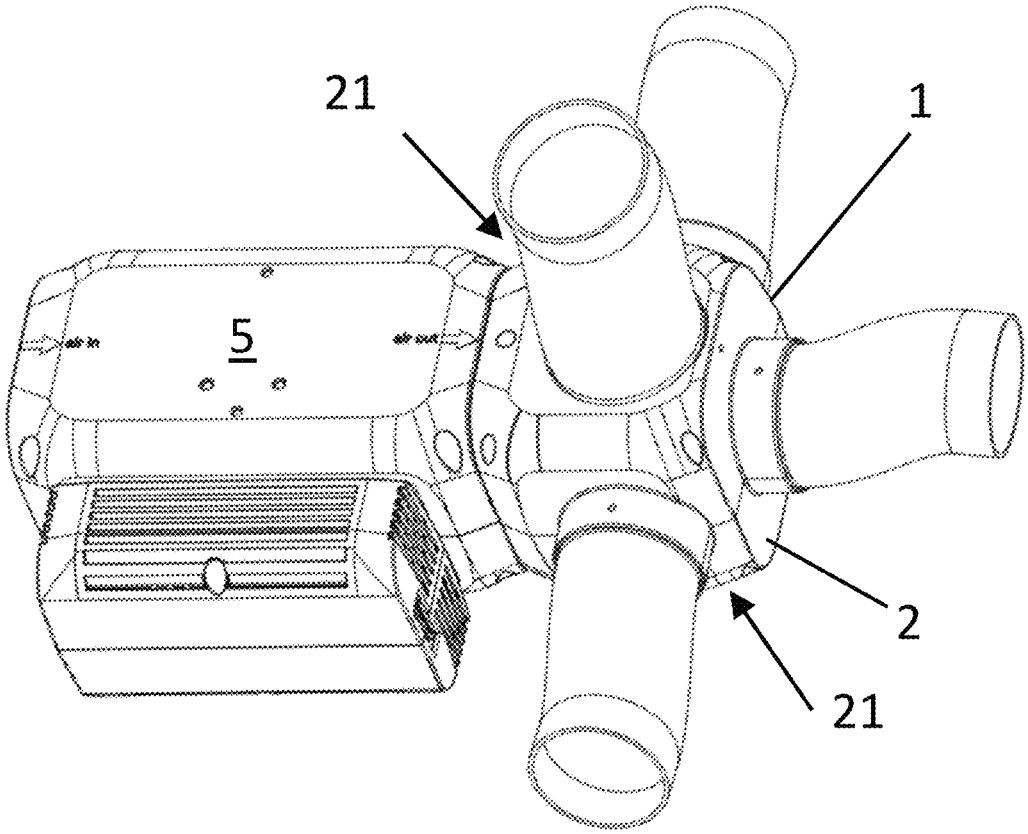
FIG. 1 shows a three-dimensional representation of the device in connection with a heater.
Figure 2:
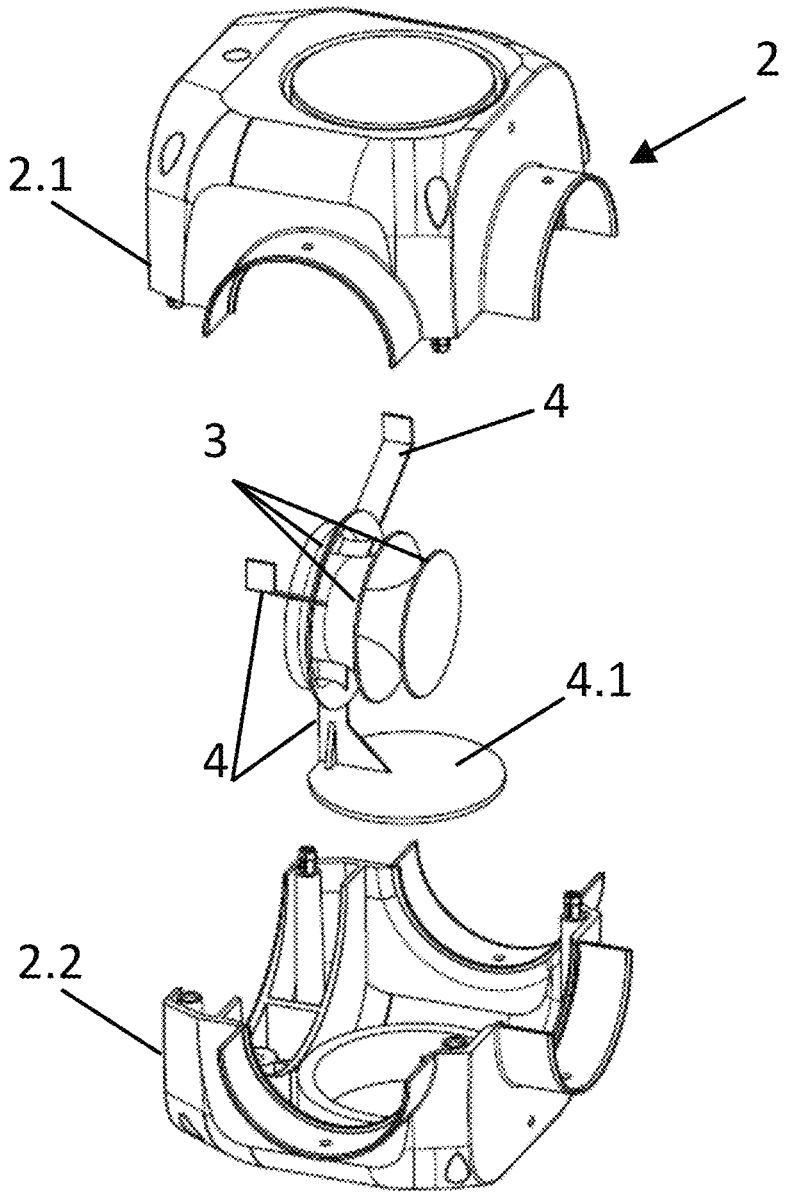
FIG. 2 shows an exploded illustration of the device.

FIG. 2 shows that the housing 2 consists of two housing halves 2.1, 2.2, which in this case more particularly are of identical design. The housing halves 2.1, 2.2 are preferably manufactured from a plastic material, e.g. injection molded.

Three displacement elements 3 are provided, which are connected to three holding webs 4. In the installed condition, the holding webs 4 serve to fasten the displacement elements 3 in the housing 2. The holding web 4, which is directed downward in the drawing here, is connected to a circular closure plate 4.1. The closure plate 4.1 allows, for one thing, the arrangement of the displacement elements 3 to be fixed in place in the housing 2 and, for another thing, closes one of the air outlet openings 21. In this configuration, a plurality of displacement elements 3 are thus connected, which together with the holding webs 4 constitute a unit, inserted into the housing 2. In particular, the unit made up of the displacement elements 3 and the holding webs 4 further includes a closure plate 4.1.

The three displacement elements 3 each have different inlet radii, which allows them to be fitted or nested into each other. The inlet radius here is the respective radius of that section of the displacement element 3 which faces the air inlet opening. The axially opposite radius is the end radius, each end radius being larger than the associated inlet radius.

The displacement element 3 with the smallest inlet radius, which is also located in the middle here, has the largest axial extent.

Furthermore, the three displacement elements 3 start from a shared plane. In an alternative configuration (not illustrated), the displacement elements 3 are arranged offset one behind the other.

Figure 3:
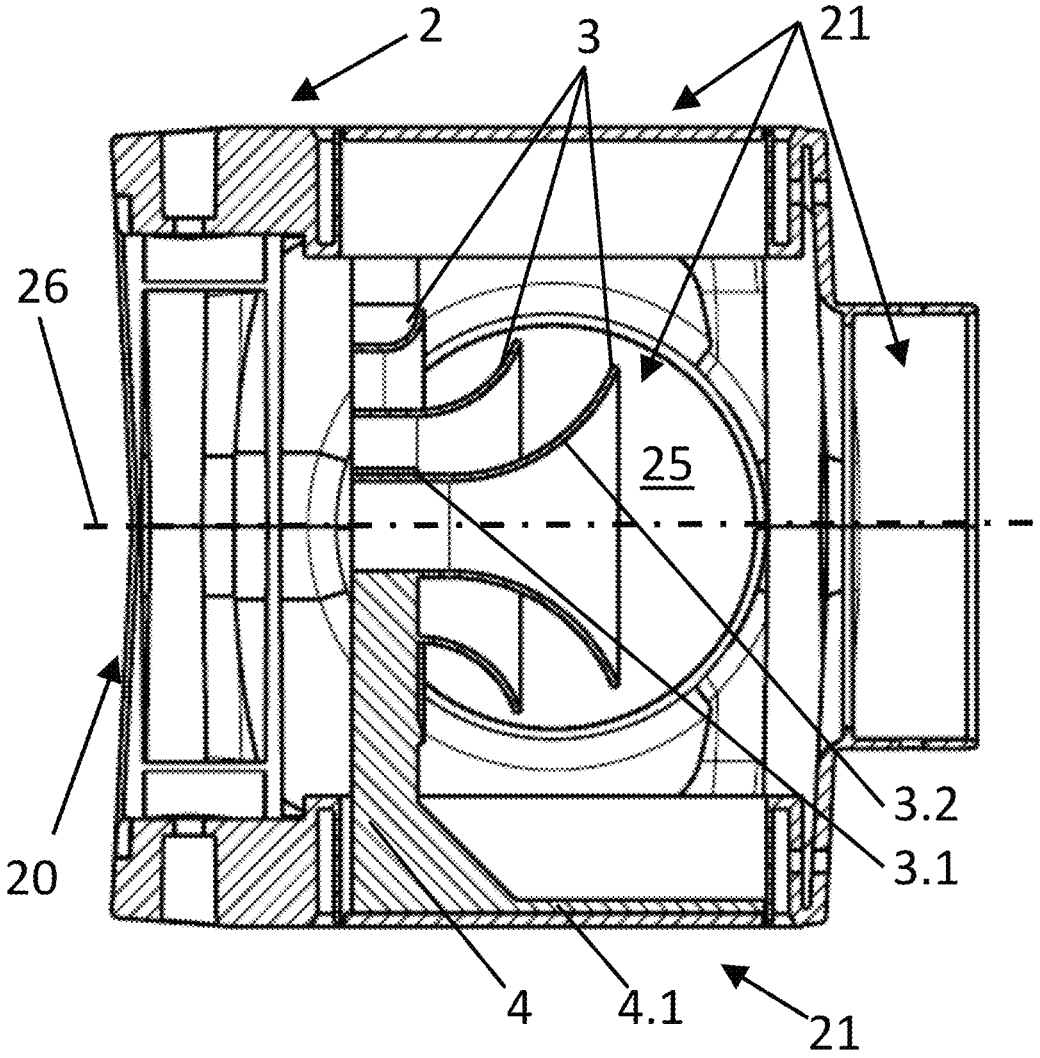
FIG. 3 shows a section taken through the device for distributing air as shown in FIG. 2.

FIG. 3 shows a section taken through the housing 2 of the device 1 of FIG. 2.

The air inlet opening 20, the opposite air outlet opening 21 and three further air outlet openings 21 are visible, which are arranged laterally to the longitudinal axis 26 and opposite each other. The lower air outlet opening 21 is closed by the closure plate 4.1 so that no air exits at this point. Notwithstanding this, about one fifth of the air entering via the air inlet opening 20 would exit through this air outlet opening 21 as well.

To obtain this effect, i.e. that essentially the same amount of air exits from the air outlet openings 21 or would exit in the open condition, three displacement elements 3 are located in the interior 25 of the housing 2 by way of example. Alternatively, further or fewer displacement elements 3 may also be provided.

The three displacement elements 3 are each rotationally symmetrical hollow cylinders having circular cross-sections. Therefore, only the cutting planes of the displacement elements 3 are visible here, which correspond to the cutting planes of hollow cylinders, in this case provided with different dimensions.

The hollow cylinders, which may also be referred to as being trumpet-shaped, are arranged along the longitudinal axis 26 such that they partly overlap axially. The displacement elements 3 are fastened to the inner wall of the interior 25 of the housing 2 by means of the holding webs 4.

The displacement elements 3 each have a first tubular section 3.1 having a constant diameter, which is adjoined by a respective second section 3.2, the diameter of which increases in the direction of the longitudinal axis 26. In the case shown, each of the three displacement elements 3 have different inlet radii and also different end radii. Moreover, the different axial extents, that is, the different lengths of the three displacement elements 3 can be seen.

The air that reaches the interior 25 of housing 2 through the air inlet opening 20 flows around the displacement elements 3 and through them. The shape and relative arrangement of the displacement elements 3 causes the inflowing air to be directed to the air outlet openings 21 in essentially equal parts. In the configuration shown, the displacement elements 3 are spaced apart from the housing 2 all around. To this end, the holding webs 4 are also designed accordingly, so that a flow around them is possible or is only slightly affected.

Figure 4:
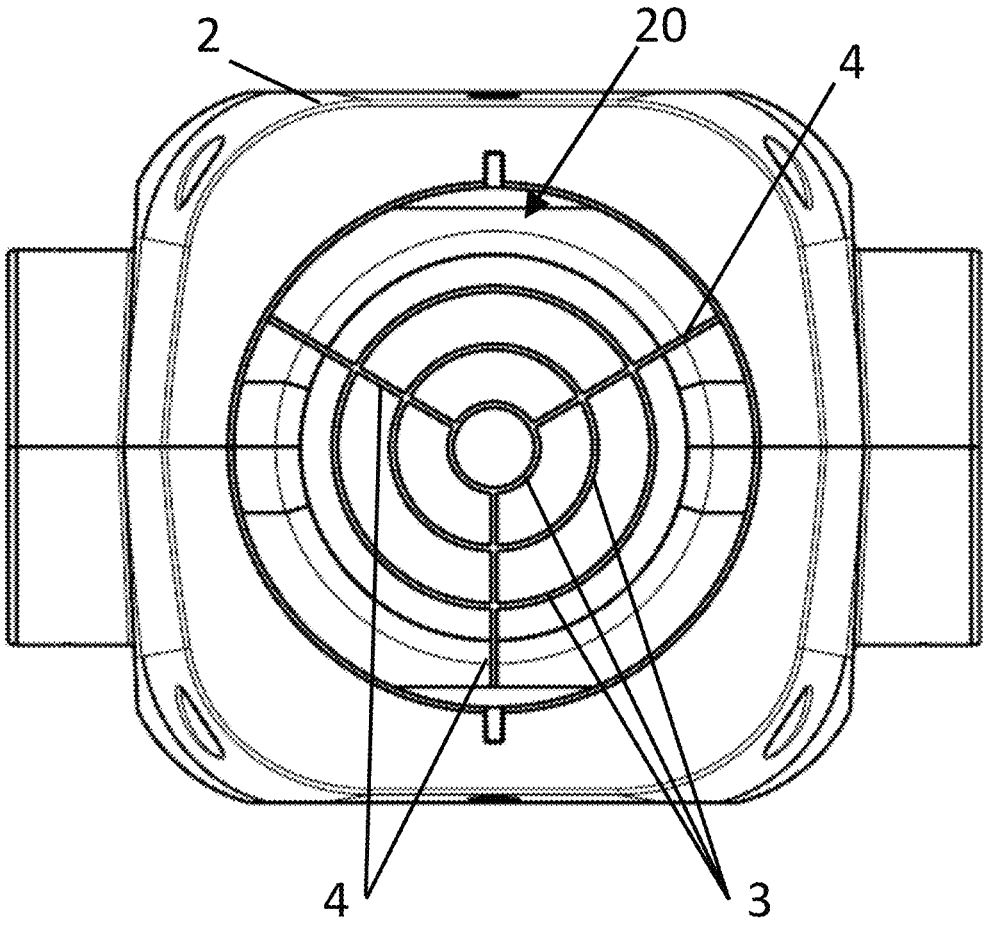
FIG. 4 shows a top view of the side with the air inlet opening of the air distribution device of FIG. 2.

The top view of FIG. 4 shows the three displacement elements 3 and the three holding webs 4 as viewed through the air inlet opening 20 of the housing 2.

The three displacement elements 3 each have different inlet radii so that they can be arranged inside each other. Each pair of holding webs 4 includes an angle of 120 degrees, so that altogether a symmetrical arrangement is obtained.

LIST OF REFERENCE NUMBERS

1 device
2 housing
2.1 housing half
2.2 housing half
3 displacement element
3.1 first section
3.2 second section
4 holding web
4.1 closure plate
5 air-expelling unit
20 air inlet opening
21 air outlet opening
25 interior
26 longitudinal axis

The invention claimed is:

1. A device for distributing air, comprising:

at least one housing, wherein:

the at least one housing has an air inlet opening and a plurality of air outlet openings, the plurality of air outlet openings is located on different sides of the at least one housing, at least two fixed displacement elements are arranged in an interior of the at least one housing, the at least two displacement elements each having at least one cutting plane that is configured as a cutting plane of a trumpet-shaped hollow cylinder widening along a longitudinal axis of the at least one housing, the at least two displacement elements are rotationally symmetrical and configured as trumpet-shaped hollow cylinders conically widening along the longitudinal axis of the at least one housing, the at least two displacement elements are spaced apart from an inner wall of the at least one housing such that air flows around the at least two displacement elements, and the device is configured such that air flows through the at least two displacement elements along the longitudinal axis and the air exits an innermost displacement element in a central area of the innermost displacement element.

2. The device according to claim 1, wherein the at least two displacement elements each include a first section having a substantially constant diameter and a second section having a diameter that increases along the longitudinal axis.

3. The device according to claim 1, wherein the at least two displacement elements partly overlap along the longitudinal axis, wherein the at least two displacement elements have different end radii and/or different inlet radii, wherein the at least two displacement elements have different axial extents, and wherein the at least two displacement elements start from a shared plane perpendicular to the longitudinal axis.

4. The device according to claim 1, wherein the air inlet opening is opposite one of the plurality of air outlet openings.

5. A device for distributing air, comprising:

at least one housing, wherein:

the at least one housing having an air inlet opening and a plurality of air outlet openings, the plurality of air outlet openings is located on different sides of the at least one housing, at least two fixed displacement elements are arranged in an interior of the at least one housing, the at least two displacement elements each having at least one cutting plane that is configured as a cutting plane of a trumpet-shaped hollow cylinder widening along a longitudinal axis of the at least one housing, the at least two displacement elements are rotationally symmetrical and configured as trumpet-shaped hollow cylinders conically widening along the longitudinal axis of the at least one housing, the at least two displacement elements are spaced apart from an inner wall of the at least one housing such that air flows around the at least two displacement elements, the at least two displacement elements are fastened to an inner wall of an interior of the at least one housing by holding webs, wherein the at least two displacement elements are all statically fixed in the at least one housing, and the device is configured such that air flows through the at least two displacement elements along the longitudinal axis and the air exits an innermost displacement element in a central area of the innermost displacement element.

6. A device for distributing air, comprising:

at least one housing, wherein:

the at least one housing has an air inlet opening and a plurality of air outlet openings, the plurality of air outlet openings is located on different sides of the at least one housing, at least two fixed displacement elements are arranged in an interior of the at least one housing, the at least two displacement elements each having at least one cutting plane that is configured as a cutting plane of a trumpet-shaped hollow cylinder widening along a longitudinal axis of the at least one housing, the at least two displacement elements being rotationally symmetrical and configured as trumpet-shaped hollow cylinders conically widening along the longitudinal axis of the at least one housing, the at least two displacement elements are spaced apart from an inner wall of the at least one housing such that air flows around the at least two displacement elements, a shape and a relative arrangement of the at least two displacement elements cause the inflowing air to be directed to the plurality of air outlet openings in essentially equal parts, and the device is configured such that air flows through the at least two displacement elements along the longitudinal axis and the air exits an innermost displacement element in a central area of the innermost displacement element.

* * * * *